US008281694B2

(12) United States Patent
Okihara

(10) Patent No.: US 8,281,694 B2
(45) Date of Patent: Oct. 9, 2012

(54) METHOD AND DEVICE FOR ADJUSTING HEIGHTS OF SLITTER BLADE

(75) Inventor: Toshinao Okihara, Hiroshima (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 255 days.

(21) Appl. No.: 12/680,969

(22) PCT Filed: Jan. 21, 2009

(86) PCT No.: PCT/JP2009/051291

§ 371 (c)(1),
(2), (4) Date: May 15, 2010

(87) PCT Pub. No.: WO2009/119151

PCT Pub. Date: Oct. 1, 2009

(65) Prior Publication Data

US 2010/0218653 A1 Sep. 2, 2010

(30) Foreign Application Priority Data

Mar. 24, 2008 (JP) ..... 2008-076034

(51) Int. Cl.
*B26D 7/26* (2006.01)
*B26D 5/02* (2006.01)

(52) U.S. Cl. ..... 83/13; 83/520; 83/522.24

(58) Field of Classification Search ..... 83/13, 174.1, 83/503, 520, 522.24, 76.8, 522.25; 76/85; 356/3.1

See application file for complete search history.

(56) References Cited

U.S. PATENT DOCUMENTS

| | | | | |
|---|---|---|---|---|
| 4,790,526 | A * | 12/1988 | Egashira | 271/315 |
| 6,158,316 | A * | 12/2000 | Ichikawa et al. | 83/74 |
| 7,104,666 | B2 * | 9/2006 | Lihl et al. | 362/89 |
| 7,578,222 | B2 * | 8/2009 | Liebheit | 83/425.4 |
| 2002/0180949 | A1 | 12/2002 | Leutz et al. | |
| 2004/0221699 | A1 | 11/2004 | Adachi et al. | |
| 2006/0101961 | A1 * | 5/2006 | Etter et al. | 83/76.8 |

FOREIGN PATENT DOCUMENTS

JP 3-108603 A 5/1991

(Continued)

OTHER PUBLICATIONS

Search Report of International Application No. PCT/JP2009/051291 mailed Apr. 12, 2009.
English Translation of the International Preliminary Report on Patentability of corresponding application No. PCT/JP2009/051291 mailed Nov. 9, 2010.

*Primary Examiner* — Ghassem Alie
(74) *Attorney, Agent, or Firm* — Kanesaka, Berner & Partners

(57) ABSTRACT

A method for adjusting a height of a circular slitter blade includes rotating the slitter blade and the receiving roll such that an outer circumferential surface of the slitter blade and the receiving roll move in the same direction as the traveling direction of the corrugated board web; emitting a light beam in a width direction of the corrugated board web to pass through a contact point of the outer circumferential surface of the receiving roll with the corrugated board web; determining a height of the slitter blade at which the circular outer edge of the slitter blade intercepts the light beam while moving the slitter blade toward the receiving roll; and setting the height of the slitter blade to the determined height as a slitting position.

5 Claims, 4 Drawing Sheets

FOREIGN PATENT DOCUMENTS

| | | | |
|---|---|---|---|
| JP | 2003-528324 | A | 9/2003 |
| JP | 2004-330351 | A | 11/2004 |
| JP | 3977914 | A | 6/2007 |
| JP | 4002209 | B2 | 8/2007 |

* cited by examiner

METHOD AND DEVICE FOR ADJUSTING HEIGHTS OF SLITTER BLADE

RELATED APPLICATIONS

The present application is based on International Application Number PCT/JP2009/051291, filed Jan. 21, 2009, and claims priority from Japanese Application Number 2008-076034, filed Mar. 24, 2008, the disclosures of which are hereby incorporated by reference herein in their entirety.

BACKGROUND OF THE INVENTION

1. Technical Field

The present application relates to a method and device for adjusting heights of a slitter blade provided in a slitter scorer for scoring and slitting a corrugated board web in a corrugated machine for manufacturing a corrugated board sheet.

2. Background Art

The corrugated board web being continuously produced along a corrugating line, is slit some boxes-out by the slitter blades near a final step of the corrugating line, and if specified, additionally formed with scorer lines thereon by the scorer rolls along the traveling line of the web. Each of the divided webs is cut along the width thereof (perpendicular to the traveling direction of the corrugated board web) by a rotary cutter, being processed into a corrugated board sheet of a specified size and being stacked into a stacker located on a downstream side of the rotary cutter.

FIG. 6 illustrate a latter part of the structure of a general corrugated machine. A corrugated board web W a top liner and a bottom liner on both sides of a corrugating medium by a single facer not shown in the figure and a double facer 2, being formed with scorer lines along a traveling direction b of the corrugated board web by a scorer unit 3 located on the downstream side of the double facer 2, and further being slit along the traveling direction b by a slitter unit 1.

The corrugated web is cut into corrugated board sheets S by a specified length of a product each (usually corresponding to the size of a corrugated board) by a cutting unit 4 on the downstream side of the slitter unit 1, and stacked into a stacking unit 5. The scorer unit 3 and the slitter unit 1 together are usually referred to as a slitter scorer.

The scorer unit forms scorer lines on the corrugated web W along the traveling direction thereof and the slitter unit 1 slits the web W at a specified position along the traveling direction b. The structure of the slitter unit is explained in reference to FIG. 7. FIG. 7 is a side view of the slitter unit along the line X-X of FIG. 6. As shown in FIG. 7, the slitter unit 1 is assembled with frames 10 on both sides thereof, and a beam 11*a* is installed with respect to the width direction of the corrugated web W (in the direction perpendicular to the traveling direction of the corrugated web W) between the frames 10 below the web W.

A guide rail 12*a* is mounted on the beam 11*a* and a plurality of slitter heads 13 (five slitter heads in FIG. 7) are supported on the guide rail 12*a* in such a manner that they can move in the width direction of the unit by a driving device 14*a* on each individual slitter head. A slitter blade of a thin disk-shaped rotating blade is rotatably attached to each of the slitter heads 13.

Above the corrugated board web W, a beam 11*b* is provided in parallel to the beam 11*a*. A guide rail 12*b* is mounted on the beam 11*a* and a plurality of receiving rolls 16 as many as the slitter heads 13, are supported on the guide rail 12*b* in such a manner that they can move in the width direction of the unit by a driving device 14*b* on each individual slitter head.

Each web slitting device comprises sets of the slitter blade 15 and the receiving roll 16, and the slitter blades 15 and receiving rolls 16 are independently movable to a specified position in the width direction of the web so as to engage with each other so that the corrugated board web W fed between the sets is cut at positions of a specified width.

Moreover, the rotation speed of the slitter blade 15 is set to be sufficiently faster than the traveling speed of the corrugated board web W so as to perform a clear slitting. Furthermore, the rotation speed of the receiving roll 16 is set to be approximately equal to and slightly faster than the traveling speed of the corrugated board web W so as not to reduce the traveling speed of the corrugated web W.

FIG. 8 illustrates a side view of a slitter head part. In FIG. 8, above the slitter head 13, a receiving table 17 extending in the traveling direction of the corrugated web W is provided integral with the slitter head. The receiving table 17 supports the corrugated board web W from underneath thereof and helps determining the level of a traveling path of the corrugated board web W.

As shown in FIG. 9, the receiving table 17 is positioned at such a height that a circular outer edge 15*a* of the slitter blade 15 protrudes through the receiving table 17 by a protrusion amount h.

The corrugated board W is slit from underneath by the rotating slitter blade 15. In this process, the edge of the slitter blade 15 is driven in such a manner that the rotation speed of the blade 15 is sufficiently faster that the traveling speed of the corrugated web W at an engaging point where the blade 15 and the web W come in contact with each other. When slitting the corrugated board web W, the rotation of the slitter blade 15 adds the corrugated board web W a force in the upward direction and the traveling direction thereof, thereby causing flipping of the corrugated web W and riding of the web W onto the slitter blade 15.

As the flipping and riding-up of the corrugated web W lowers the slitting quality of the web W, the flipping and riding-up of the web W is prevented in such a way that the receiving roll 16 presses down the corrugated board web W, thereby improving the slitting quality of the corrugated board web.

Moreover, as shown in FIG. 8 a groove 16*a* is carved on the outer circumference of the receiving roll 16, and an adequate clearance is secured so as not to allow interference of the edge of the slitter blade 15 and the outer circumference of the receiving roll 16 with each other. In this manner, wear of the receiving roll 16 caused by the contact with the slitter blade 15 is prevented.

As FIG. 9 illustrates, the position of the conventional slitter blade 15 is controlled by adjusting the protrusion amount h of the slitter blade 15 above the receiving table 17. Specifically, the protrusion amount h is determined by placing the slitter blade 15 against a jig with a predetermined dimension, which is preliminarily mounted on the receiving table 17.

The slitter blade 15 needs to be sharpened as the edge of the blade 15 becomes worn. As shown in FIG. 9, according to the conventional method, sharpening the slitter blade 15 reduces the radius of the slitter blade 15 (15→15'), and causes the engaging point of the blade 15 and the receiving roll 16 to change from $a^1$ to $a^2$ although the protrusion amount h of the blade is constant. Thus, there occurs a problem that the engaging point is not adjustable even if the protrusion amount h of the blade is controlled.

Related Patent 1 (JP2004-330351A) discloses a means for slitting a corrugated board web in a steady manner wherein radii of circular slitter blades, which become smaller due to wear from regular usage or being sharpened, are measured, the height position of the slitter blade being corrected in accordance with the measurements, and engagement amount of the receiving roll and the slitter blade being properly secured.

This conventional means for slitting the corrugated board web comprises an optical sensor having an optical axis in a parallel relationship with respect to the surface of the corrugated board web, wherein the slitter blade is moved in the vertical direction to interrupt the optical axis, the radius of the slitter blade being calculated from the measured position of the slitter blade, and the slitter blade being moved in the vertical direction according to the results of the calculation, thereby controlling the depth of the engagement of the receiving roll with the slitter blade The means disclosed in Related Patent 1 includes the step for calculating the radius of the slitter blade, which complicates a control system thereof and creates higher cost. Moreover, depending on the precision of the control system, there may be an error in calculating the depth of the engagement of the slitter blade and the receiving roll and an optimal depth of the engagement cannot be attained. Furthermore, the means of Related Patent 1 merely controls the depth of the engagement between the receiving roll and slitter blade and is not capable of controlling an engaging point between the receiving roll and slitter blade.

SUMMARY OF THE INVENTION

In view of the above-stated conventional technology and anticipated solutions thereof, objects of the present invention are to set an optimal engaging point of a receiving roll and a slitter blade so as to ensure qualities of slit section of the corrugated board web, and to provide a simplified and cheaper device for setting the optimal engaging point.

In order to achieve one of the objects, the present invention provides a method for adjusting a height of a circular slitter blade which slits a corrugated board web traveling continuously along a traveling direction thereof while the corrugated board web being interposed between a receiving roll and a circular slitter blade, comprising the steps of:

rotating the slitter blade and the receiving roll such that outer circumferential surfaces of the slitter blade and the receiving roll move in the same direction as the traveling direction of the corrugated board web, the slitter blade having a center that is located on a downstream side of a center of the receiving roll in the traveling direction of the corrugated board web;

emitting a light beam in a width direction of the corrugated board web to pass through a contact position of the outer-circumferential surface of the receiving roll with the corrugated board web;

determining a height of the slitter blade at which the circular outer edge of the slitter blade intercepts the light beam while moving the slitter blade toward the receiving roll; and setting the height of the slitter blade to the determined height as a slitting position.

FIG. 1 shows a schematic view of a slitter head part illustrating a relevant part of the present invention. In the process of making this invention, it was discovered that in the case of slitting the web only with thin blades (circular slitter blades) whose rotation is set to "the rotation speed of the slitter blade/the traveling speed of the corrugated web≧2", an optimal engaging point of a slitter blade 15 and a receiving roll 16 should be set to the point at which the circular slitter blade 15 passes through a corrugated board web W after slitting the web W in order to ensure qualities of the slitting of the web as shown in FIG. 1.

The point a is where the outer-circumferential surface of the receiving roll 16 comes in contact with the corrugated web W, and is an intersection point of a vertical line $C_2$ drawn through the center $O_2$ of the receiving roll 16 and the outer-circumferential surface of the receiving roll 16. After the circular outer edge 15*a* of the slitter blade 15 slits the corrugated board web W, the receiving roll 16 receives the corrugated board web W at the point a at which the slitter blade 15 passes through the corrugated web W, so as to suppress flipping of a top surface of the corrugated web at which the web W is slit and to prevent a damage of the slit section.

A center $O_1$ of the slitter blade 15 is located on the downstream side of the traveling direction of the corrugated board web with respect to the center $O_2$ of the receiving roll 16. Specifically, a vertical line $C_1$ drawn through the center $O_1$ of the slitter blade 15 is located on the downstream side of the traveling direction of the web W by a distance δ with respect to a vertical line $C_2$ drawn through the center $O_2$ of the receiving roll 16. The slitter blade 15 and the receiving roll 16 rotate in the direction shown with arrows d and a respectively so that the outer-circumferential surface thereof move in the same direction as the corrugated web W.

In this manner, a relative position of the slitter blade 15 and the receiving roll 16 is determined and the light beam (laser beam or diffusive light) is emitted to pass through the point a in the width direction of the corrugated web. Then, a height of the slitter blade at which the circular outer edge 15*a* of the slitter blade 15 intercepts the light beam is determined while moving the slitter blade 15 toward the receiving roll 16, and the height of the slitter blade being set to the determined height as a slitting position for the slitter blade 15. With this method, the height of the slitter blade 15 is easily adjusted to the engaging point a.

The radius of the slitter blade 15 changes over time due to friction during the operation, sharpening of the blade or the like.

According to the method disclosed by the present invention, even when the radius of the slitter blade 15 changes due to the friction during the operation, sharpening of the blade or the like, i.e. the outer edge of the slitter blade changes from 15 to 15' as shown in FIG. 2, the optimal engaging point a remains the same by adjusting the height of the slitter blade. Therefore, a protrusion amount h above a top surface of the receiving table 17 can be changed.

According to the present invention, the light beam is emitted to pass through the point a in the width direction of the corrugated web, a height of the slitter blade at which the circular outer edge 15*a* of the slitter blade 15 intercepts the light beam being determined while moving the slitter blade 15 toward the receiving roll 16, and the height of the slitter blade being set to the determined height as a slitting position for the slitter blade 15. This method saves complicated calculation to determine the optimal engaging point, and there is no need for a complicated control device and the height of the slitter blade 15 is easily adjusted to the engaging point at low cost. Thus, the corrugated web W can be slit in a steady manner.

In the present invention, in the case of using laser beam as a light beam, the light beam can be aimed at the point with high accuracy. Therefore, the height of the slitter blade can be determined with high accuracy as well. As described hereinafter, in the case of using a diffusive light as a light beam, an error from the outer edge of the diffusive light needs to be corrected. However, the method with the laser beam does not need a step for correcting such an error, thereby saving an arithmetic circuit for correcting the error and making a detection device simple and inexpensive.

Furthermore, it is preferable that the light beam is diffusive light, and the step of determining the height of the slitter blade includes: measuring an interception position where the circular outer edge of the slitter blade intercepts the outer edge of the diffusive light; and adding an correction value determined from a diffusion angle of the diffusive light to the measured interception position so as to determine the height of the slitter blade.

It is also preferable that the light beam is diffusive light, the step of determining the height of the slitter blade includes: measuring an interception position where the circular outer edge of the slitter blade intercepts the outer edge of the diffusive light, the interception position being measured at a predetermined distance from a light source of the diffusive light in the width direction of the corrugated board web; calculating a diffusion angle of the diffusive light from the distance and the interception position; and adding an correction value determined from the calculated diffusion angle to the measured interception position so as to determine the height of the slitter blade.

In the process described above, the correction value for the slitter blade is obtained from only one position in the width direction of the web. In order to obtain correction values for other slitter blades, a correction value for each blade at each position in the width direction of the web can be easily obtained by comparing with the distance from the light source and modifying the previously obtained correction value for the first blade. Thus, even if the diffusion angle is unknown, the outer edge of the slitter blade can be adjusted to the optimal engaging point a.

Moreover, the present invention suggests a device for adjusting the height of a circular slitter blade which slits a corrugated board web traveling continuously along a traveling direction of the corrugated board web while the corrugated board web being interposed between a receiving roll and a circular slitter blade, the receiving roll and the circular slitter blade having outer circumferential surfaces that move in the same direction as the traveling direction of the corrugated board web, the circular slitter having a center that is located on a downstream side of a center of the receiving roll in the traveling direction of the corrugated board, the device comprising:

an emitting device which emits a light beam in a width direction of the corrugated board web to pass through a contact position of the outer circumferential surface of the receiving roll with the corrugated board web;

a light receiver which receives the light beam;

an actuator which moves the slitter blade close toward or away from the receiving roll;

a memory device which memorizes a height of the slitter blade where the circular outer edge of the slitter blade intercepts the light beam; and a controller which controls the actuator so as to move the slitter blade toward the receiving roll to the height where the circular outer edge of the slitter blade intercepts the light beam.

The interception point where the circular outer edge of the slitter blade intercepts the light beam can be determined by presence or absence of the light beam received by the light receiver. In this manner, the corrugated board web is slit at the optimal engaging point of the slitter blade and the receiving roll, thereby maintaining qualities of slit sections of the corrugated board web. Moreover, there is no need for a complicated and expensive control device for determining the optimal engaging point.

According to the method and the device of the present invention, the optimal engaging point of the receiving roll and the slitter blade in a slitter unit is obtained, and the slitter blade is positioned to the optimal engaging point in a simplified manner, thereby ensuring qualities of the slit sections of the corrugated web at low cost.

DETAILED DESCRIPTION OF THE INVENTION/BEST MODE FOR CARRYING OUT THE INVENTION

Hereafter, the present invention will be described in detail with reference to the embodiments shown in the figures. However, the dimensions, materials, shape, the relative placement and so on of a component described in these embodiments shall not be construed as limiting the scope of the invention thereto, unless especially specific mention is made.

First Embodiment

Figure 3:
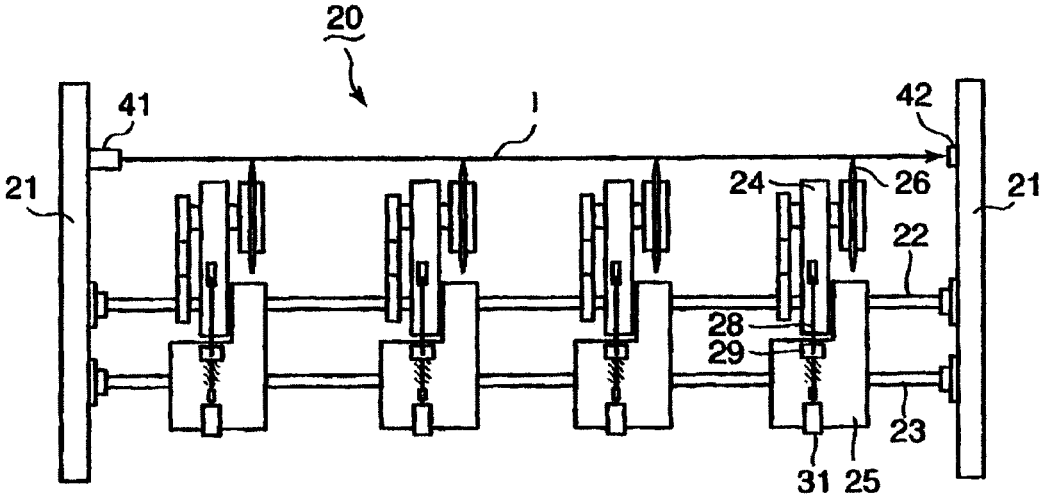
FIG. 3 is a side view of a slitter device in relation to a first embodiment of the present invention.
Figure 4:
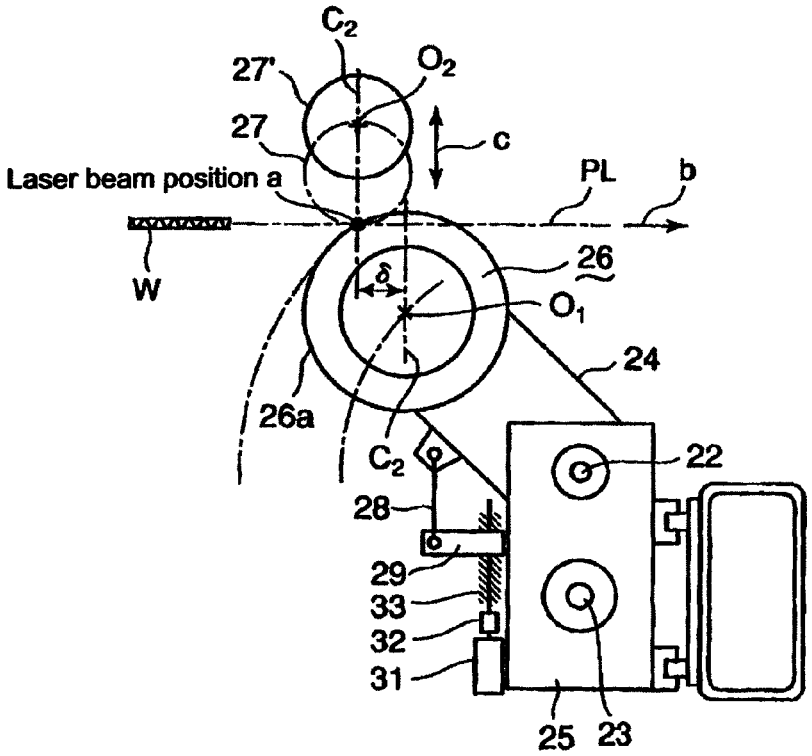
FIG. 4 is a front view of a slitter head in relation to a first embodiment of the present invention.

A first embodiment of the present invention will be explained in reference to FIG. 3 and FIG. 4. FIG. 3 is a side view of a slitter device in relation to the first embodiment of the present invention. FIG. 4 is a front view of a slitter head in relation to the first embodiment of the present invention.

In FIG. 3 and FIG. 4, a slitter device 20 slits a corrugated web W along a traveling direction of the web W at predetermined positions in a width direction of the web W. The slitter device 20 is constructed with frames 21 on both sides thereof, a driving axis 22 for blades and a position setting axis 23 for moving devices in the width direction of the corrugated board web W, the driving axis 22 and the position setting axis 23 being located between the frames 21 and below a traveling line PL of the corrugated board web W.

The driving axis 22 for the blades and the position setting axis 23 for moving devices have a plurality of slitter heads 24 and moving devices 25 (four sets are shown in the drawing) movable in the width direction of the devices. A slitter blade 26 which is a thin disk-shaped rotating blade, is rotatably attached to each of the slitter heads 24. Above the slitter heads 24, the same number of receiving rolls 27 as the slitter heads are installed movably in the width direction of the device via a moving device which are not shown in the drawing. Specifically, each web-slitting device is constructed by a set of the slitter blade 26 and the receiving roll located below and above of the traveling line PL of the corrugated board web W respectively. The receiving rolls 27 are omitted from FIG. 3.

The slitter blade 26 and receiving roll 27 of each of the web slitting devices, are movable in the width direction of the corrugated web W independently to a specified position, the blades 26 and the rolls 27 being positioned to make a pair, and the corrugated board web W being fed between thereof so as to slit the corrugated board web W at a specified position in the width of the web W.

Each of the slitter heads 24 is mounted rotatably to the driving axis 22 for the blades, and being connected to a female screw part 29 via a connection rod 28. A servomotor 31 is installed on a outer surface of the moving device 25 and the servomotor 31 has a piston rod 32 whose tip is connected to male screw 33. The male screw 33 and the female screw part 29 are screwed together such that the male screw 33 and the female screw part 29 move correspondingly to each other by actuation of the servomotor 31. In this manner, the female screw part 29 moves in the vertical direction. By the vertical movement of the female screw part 29, the slitter blade 26 rotates around the driving axis 22 in such a manner that the blade 26 moves towards and away from the receiving blade 27. (The relative movement of the male screw 33 and the female screw part 29 corresponds to an actuator and the servomotor corresponds to a controller for controlling the actuator in the present invention)

A center $O_1$ of the slitter blade 26 is located on a downstream side of a center $O_2$ of the receiving roll in the traveling direction of the corrugated board web W. Specifically, a vertical line $C_1$ drawn through the center $O_1$ of the slitter blade 26 is located on the downstream side of the traveling direction of the web W by a distance δ with respect to a vertical line $C_2$ drawn through the center $O_2$ of the receiving roll 27.

Figure 1:
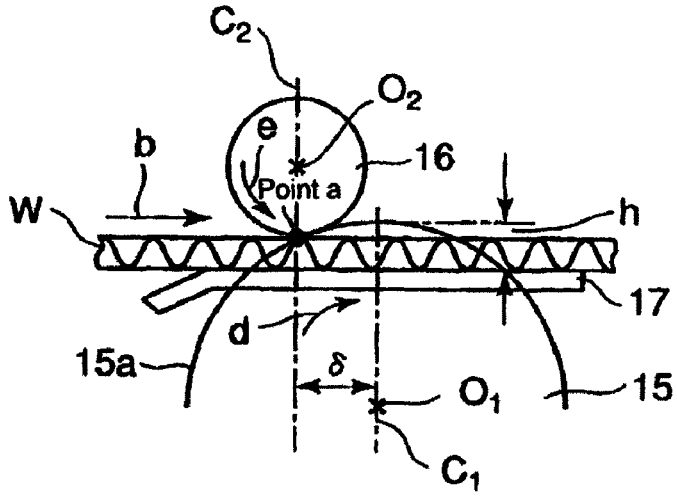
FIG. 1 shows a schematic view of a slitter head part illustrating a relevant part of the present invention.
Figure 2:
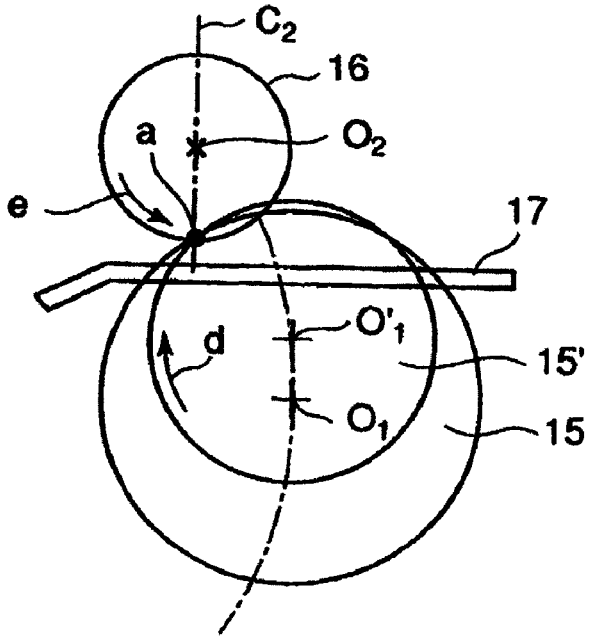
FIG. 2 shows a schematic view of a slitter head part illustrating a relevant part of the present invention.

Moreover, a laser beam 1 is emitted in a width direction of the apparatus that is vertical to the traveling direction b of the corrugated board web W, to a point a at which the lowest point of the outer edge of the receiving roll 27 touches a top surface of the corrugated board web W as shown in FIG. 1.

As illustrated in FIG. 3, across the traveling line PL of the corrugated board web W, a laser emitting device 41 is provided on one of the frames 21, and a light receiver 42 is provided on the other one of the frames 21. The laser emitting device 41 is constructed such that the laser 1 is emitted through the position a horizontally with respect to the width direction of the apparatus and being received by the light receiver 42. It is preferable to provide a mirror instead of the light receiver 42 so that the laser beam 1 emitted from the emitting device 41 is reflected by the mirror and reflected light from the mirror is received by a receiving part integrated in the emitting device 41.

With this configuration disclosed in the present embodiment, it will be explained how to determine a slitting position at which the receiving roll 27 and the slitter blade 26 engage with each other. During an operation of the corrugated machine, the corrugated board web W travels over the point a, thus a step for determining the slitting position is performed when the corrugated web does not travel over the point a such as before and after the operation. Moreover, during the step for determining the position, the receiving roll 27 is moved upward in a direction c shown with an arrow from a height shown with a dash line (shown as 27) to an elevated height shown as 27' so as not to intercept the laser beam 1.

Next, the servomotor 31 is actuated so as to elevate the slitter head 24. Then, a circular outer edge **26*a* of the slitter blade 26 reaches the position a of the laser beam and the light receiver 42 detects the interception of the laser beam 1, and fixing the slitter blade 26 at the height. The point determined in the process is a optimal engaging point, and the height at which the slitter blade 26** is to be fixed, is memorized in a memory device not shown in the drawing.

In the case of adjusting the height of more than one slitter blade 26, once the height for the first slitter blade 26 is determined, the slitter head 24 supporting the first slitter blade 26 is lowered so as not to intercept the laser beam 1 for a second blade 26 and a second slitter head 24 for the second slitter blade 26 is elevated and a height of the second slitter blade 26 mounted on the second slitter head 24 is adjusted.

According to this embodiment, the slitter blade 26 and the receiving roll 27 engage with each other at the point a at which the circular outer edge **26*a* of the slitter blade 26 passes through the corrugated board web W so that slitting of the corrugated web W in a stable manner is achieved and a quality of the slit sections of the web is ensured as explained in reference to FIG. 1. Specifically, the corrugated board web W is received by the receiving roll 16 at the point a at which the outer edge 26*a* of the slitter blade 26** passes through the corrugated board web W, thereby preventing flipping of a top surface of the corrugated web where the web W is slit and also preventing a damage of the slit section. Thus, quality of the slit sections of the web is ensured.

Furthermore, the laser 1 is emitted to the point a across the width of the corrugated board web W, the slitter head 24 being elevated, and the slitter blade 26 being positioned at a height at which the slitter blade 26 intercepts the light beam 1. Thus, the there is no need for a complicated control device and the height of the slitter blade 26 can be adjusted at low cost. It is also preferable to set the radius of the laser beam 1 between 0.1 and 2.0 mm.

In this embodiment, the servomotor is provided as a driving device which moves the slitter head 24 upward or downward. It is also preferable to use a conventional motor such as a gear motor. In such a case, an elevation measuring device such as an encoder may be installed so that even small movement of the slitter blade 26 in the vertical direction is controlled.

Embodiment 2

Figure 5:
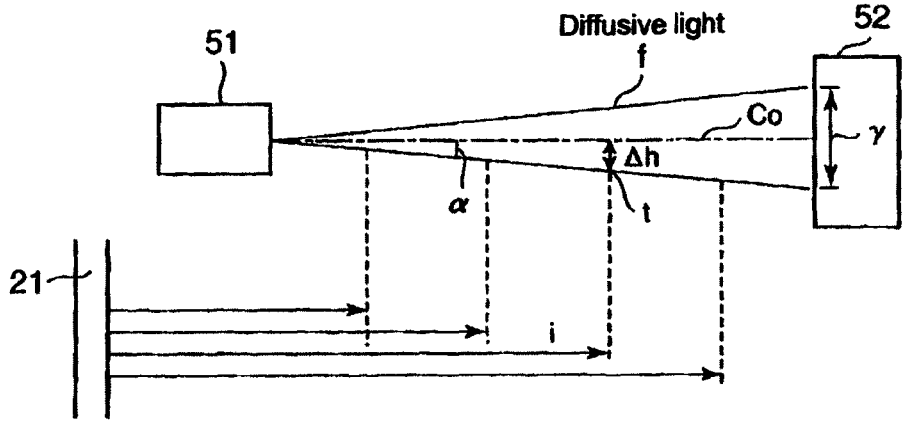
FIG. 5 illustrates an emitting device which emits a diffusive light in relation to a first embodiment or a third embodiment of the present invention.
Figure 6:
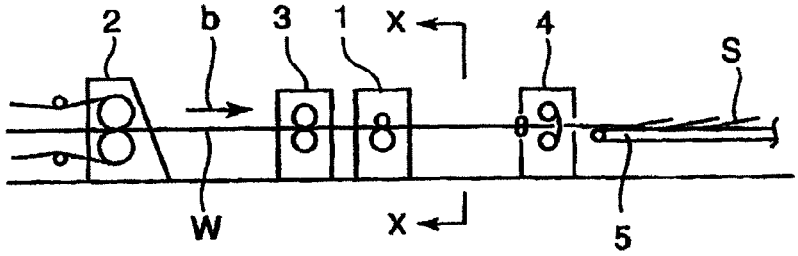
FIG. 6 is a pattern diagram showing a latter half of a corrugated machine.
Figure 7:
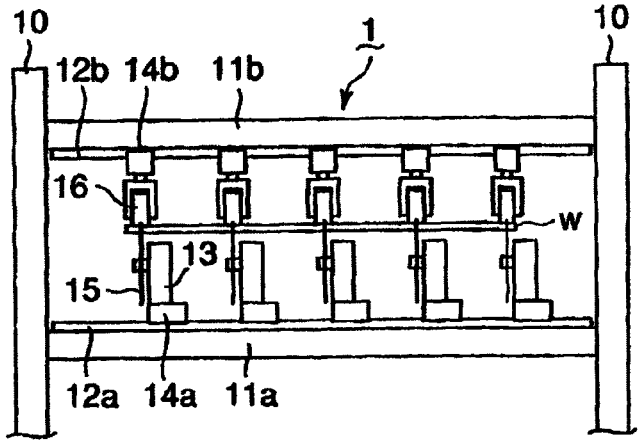
FIG. 7 is a side view take along the line X-X of FIG. 6.
Figure 8:
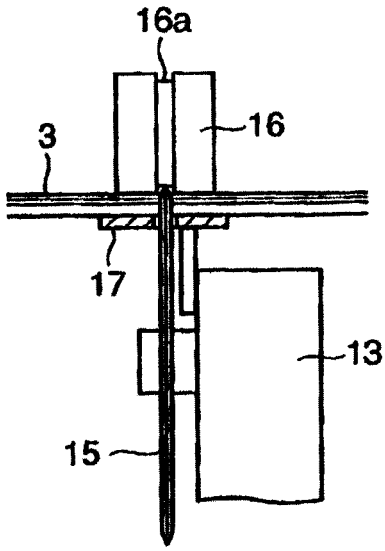
FIG. 8 is an enlarged sectional view of a slitter head part.
Figure 9:
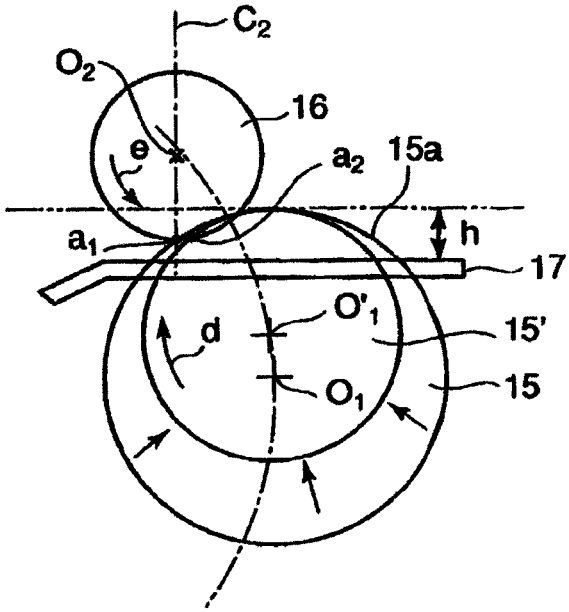
FIG. 9 is an illustration explaining a method for adjusting a height of a slitter blade of the prior art.

A second embodiment of the present invention will be explained in reference to FIG. 5. In this embodiment, the light beam is a diffusive light f which diffuses as it travels, such as visible light, infrared light and ultraviolet light. When an emitting device 51 such as a photo cell, emits a diffusive light f, the diffusive light diffuses around the center axis $C_0$ and a light receiver 52 receives the diffused light within a range r in which the light diffuses.

Therefore, in the case of using the diffusive light f, the slitter blade 26 is elevated and a memory device not shown in the figure memorizes the height of the slitter bade 26 at which the circular outer edge **26*a* thereof reaches the outer edge t of the diffusive light f. However, in the case of making the memorized height of the slitter blade 26 as a final height, there is an error (e.g. Δh), which is a diffusion amount of the diffusive light f. Thus, a diffusion angle α is measured from the center axis $C_0$ of the diffusive light f, Δh calculated from the diffusion angle α being added to the height of the outer edge t of the diffusive light f so as to determine a final slitting position of the slitter blade 26, i.e. a final height of the blade 26**.

In this manner, the engaging point of the slitter blade 26 and the receiving roll 27 is set to the optimal engaging point a. Thus, even in the case of using the diffusive light, the setting of the circular outer edge **26*a* of the slitter blade 26** to the optimal engaging point a is precisely performed.

Third Embodiment

A third embodiment of the present invention will be explained in reference to FIG. 5. According to the third embodiment of the present invention using a diffusive light, the slitting position for the slitter blade 26 is determined in a different method instead of measuring the diffusion angle $\alpha$. As illustrated in FIG. 5, the slitter blade 26 is positioned at a predetermined distance i from one of the frames 21. At the position, the slitter blade 26 is elevated and a memorizing device not shown in the figure memorizes the height of the slitter blade 26 at which the circular outer edge 26*a* thereof reaches the outer edge t of the diffusive light f.

Next, the slitter head 24 is temporarily lowered, thin test paper being wrapped around the outer-circumferential surface of the receiving roll 27 and the receiving roll 27 being lowered to a point at which the lowest point of the outer-circumferential surface of the receiving roll 27 comes in contact with a top surface of the corrugated web W. Then, the slitter blade 26 is elevated to the memorized height memorized in the memorizing device in the previous step, and the slitter blade 26*b* slicing off only an engaging area on the test paper so as to form a test engaging area. The test engaging area formed on the test paper and an ideal engaging area formed when the blade is elevated to the optimal engaging point a, are compared and a difference thereof being geometrically calculated. $\Delta h$ is calculated from the geometrically-calculated difference and being added to the height of the outer edge t so as to determine the slitting position for the slitter blade 26, i.e. the height of the blade 26.

In this manner, the circular outer edge 26*a* of the slitter blade 26 is precisely set to the optimal engaging point a.

Moreover, in the first, second and third embodiments, the receiving rolls 27 and the slitter blades 26 are located above and below of the traveling line PL of the corrugated web W respectively, but the present invention is also applicable to the case that the positions of the receiving rolls 27 and slitter blades 26 are reversed.

INDUSTRIAL APPLICABILITY

According to the present invention, the optimal engaging point of the receiving roll and the slitter roll is precisely obtained, and the slitter blade is easily positioned to the optimal engaging point, thereby stabilizing the slitting of the corrugated board web at a slitter device, and further ensuring qualities of the slit sections of the corrugated board web.

The invention claimed is:

1. A method for adjusting a height of a circular slitter blade which slits a corrugated board web traveling continuously along a traveling direction of the corrugated board web while the corrugated board web being interposed between a receiving roll and the circular slitter blade, comprising the steps of:

rotating the slitter blade and the receiving roll such that an outer circumferential surface of the slitter blade and the receiving roll move in the same direction as the traveling direction of the corrugated board web, the slitter blade having a center that is located on a downstream side of a center of the receiving roll in the traveling direction of the corrugated board web;

emitting a light beam in a width direction of the corrugated board web to pass through a contact point of the outer circumferential surface of the receiving roll with the corrugated board web;

determining a height of the slitter blade at which the circular outer edge of the slitter blade intercepts the light beam while moving the slitter blade toward the receiving roll; and setting the height of the slitter blade to the determined height as a slitting position.

2. The method for adjusting the height of a circular slitter blade according to claim 1, wherein the light beam includes a laser beam.

3. The method for adjusting the height of a circular slitter blade according to claim 1, wherein the light beam is a diffusive light, and The step of determining the height of the slitter blade includes: measuring an interception position where the circular outer edge of the slitter blade intercepts the outer edge of the diffusive light; and adding an correction value determined from a diffusion angle of the diffusive light to the measured interception position so as to determine the height of the slitter blade.

4. The method for adjusting the height of a circular slitter blade according to claim 1, wherein the light beam is a diffusive light, the step of determining the height of the slitter blade includes: measuring an interception position where the circular outer edge of the slitter blade intercepts the outer edge of the diffusive light, the interception position being measured at a predetermined distance from a light source of the diffusive light in the width direction of the corrugated board web; calculating a diffusion angle of the diffusive light from the distance and the interception position; and adding an correction value determined from the calculated diffusion angle to the measured interception position so as to determine the height of the slitter blade.

5. A device for adjusting the height of a circular slitter blade which slits a corrugated board web traveling continuously along a traveling direction of the corrugated board web while the corrugated board web being interposed between a receiving roll and a circular slitter blade, the receiving roll and the circular slitter blade having outer circumferential surfaces that move in the same direction as the traveling direction of the corrugated board web, the circular slitter having a center that is located on a downstream side of a center of the receiving roll in the traveling direction of the corrugated board, the device comprising:

an emitting device which emits a light beam in a width direction of the corrugated board web to pass through a contact position of the outer circumferential surface of the receiving roll with the corrugated board web;

a light receiver which receives the light beam;

an actuator which moves the slitter blade close toward or away from the receiving roll;

a memory device which memorizes a height of the slitter blade where the circular outer edge of the slitter blade intercepts the light beam; and a controller which controls the actuator so as to move the slitter blade toward the receiving roll to the height where the circular outer edge of the slitter blade intercepts the light beam.

* * * * *

UNITED STATES PATENT AND TRADEMARK OFFICE

CERTIFICATE OF CORRECTION

PATENT NO. : 8,281,694 B2
APPLICATION NO. : 12/680969
DATED : October 9, 2012
INVENTOR(S) : Toshinao Okihara It is certified that error appears in the above-identified patent and that said Letters Patent is hereby corrected as shown below:

Title page item (73); the Assignee "Mitsubishi Heavy Industries, Ltd.," was incorrectly stated.

The correct Assignee should read "Mitsubishi Heavy Industries Printing & Packaging Machinery, Ltd" on the patent deed.

Signed and Sealed this
Twenty-second Day of January, 2013

David J. Kappos

David J. Kappos
*Director of the United States Patent and Trademark Office*